United States Patent [19]

Vallet

[11] 4,048,604

[45] Sept. 13, 1977

[54] MAGNETIC CORE

[76] Inventor: Francisco Arjona Vallet, Trav. Jose Antonio No. 1, Avila, Spain

[21] Appl. No.: 670,356

[22] Filed: Mar. 25, 1976

[30] Foreign Application Priority Data

Mar. 25, 1975 Spain ..... 436016

[51] Int. Cl.[2] ..... H01F 27/24

[52] U.S. Cl. ..... 336/83; 336/165; 336/178; 336/212

[58] Field of Search ..... 336/160, 165, 83, 212, 336/229, 233, 234, 155, 178

[56] References Cited

U.S. PATENT DOCUMENTS

| | | | |
|---|---|---|---|
| 527,070 | 10/1894 | Packard | 336/83 |
| 2,696,593 | 12/1954 | Dole | 336/83 |
| 2,949,591 | 8/1960 | Craige | 336/83 |

*Primary Examiner*—Thomas J. Kozma
*Attorney, Agent, or Firm*—Eric Y. Munson

[57] ABSTRACT

The present invention refers to a magnetic core comprising flat magnetic plates superimposed and joined in order to constitute the toroidal form of the core, creating an internal space for the winding and a lateral air gap groove. There being assembled in the open space of the core or air gap, annulling it, an open hoop made of magnetic material having suitable dimensions, whose outer edge penetrates into the interior space of the winding in order thus to create a new internal air gap because the external diameter of the hoop is smaller than the internal diameter of the space available for the inductance coils. In this way a magnetic shunt is situated between the inductance coils in order to regulate their mutual inductance.

1 Claim, 3 Drawing Figures

MAGNETIC CORE

SUMMARY OF THE INVENTION

The present invention contemplates improvements in the construction of magnetic cores for electric inductance apparatus, which represents a novel and substantial advancement over the present state of the art.

The improvements that are the subject of the present invention have been studied and developed with complete success in order to make it possible to house two or more induction coils in toroidal magnetic cores and to place a magnetic shunt between them in order to regulate the mutual inductance, thus improving the working conditions of the reactances.

These improvements are based on the construction of a toroidal core formed by flat plates duly assembled in order to form the annular core constituting an internal rectangular space for housing the induction coil, as well as an open space in one of the branches of the core in order to provide the corresponding and necessary air gap in which is placed an incomplete hoop of magnetic material situated in the centre of the space. The coil is housed, in such a way that the external main air gap is annulled in order to create a new internal air gap, making it possible to house at least two coils situating between them the magnetic shunt which regulates their mutual inductance.

The invention is described in the following description by reference to the accompanying drawings which show by way of example a preferred embodiment.

DESCRIPTION OF THE PREFERRED EMBODIMENT OF THE INVENTION

Figure 1:
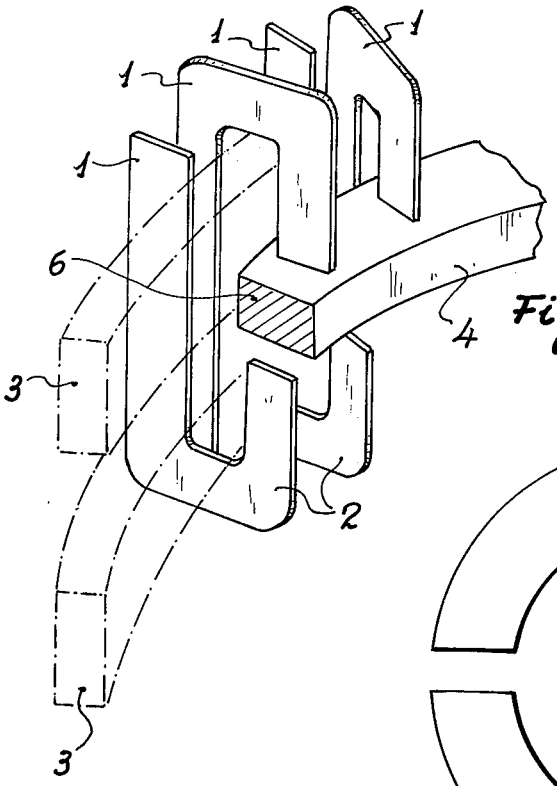
FIG. 1 shows a perspective view of the assembly of the reactance in accordance with the invention.

Referring to the drawings; and more particularly to FIG. 1, the magnetic toroidal core in accordance with the invention is constituted by a number of flat plates (1), preferably in the shape of a J in such a way that by joining the longer ends of a suitable number of plates a toroidal form is created, owing to the double thickness formed by the joined ends or branches, while the shorter bent branches (2) form a single thickness, leaving a free space between the ends of the shorter branches (2) in the form of a primary air gap.

Figure 3:
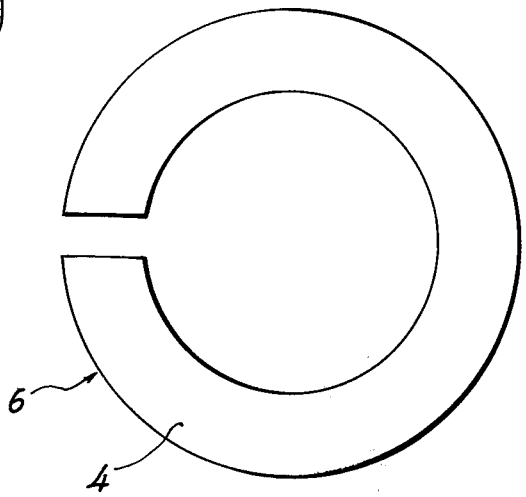
FIG. 3 shows plan view of a magnetic hoop to be applied in the air gap of the core.
Figure 2:
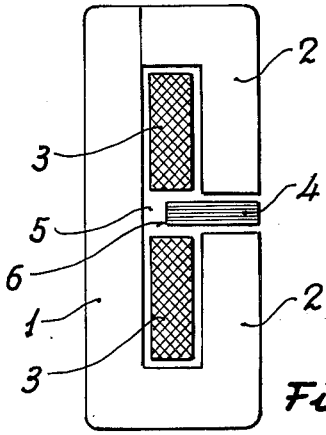
FIG. 2 represents a cross-section of a core in accordance with the invention.

It is pointed out that, for the purposes of the present invention, the toroidal magnetic core may be obtained with other types of flat plates, duly combined for the purpose, since the basic concept of the present invention contemplates a suitable dimensioned open hoop (4) of magnetic material (FIG. 3) placed in the air gap between the smaller branches (2) and the primary air gap produced on forming the core, and therefore annulling it. As illustrated in FIGS. 1 and 2, the outer edge (6) of the hoop penetrates up to the mid-zone of the internal space which houses the induction coils (3), in order to create a new internal air gap (5) because the external diameter of the hoop is smaller than the internal diameter of the space available.

In this way it is possible to house at least two coils (3) in the interior of the toroidal core situating between them a magnetic shunt created by the hoop (4) in order to regulate their mutual inductance.

What is claimed is:

1. An improved construction of an electric inductance apparatus, comprising flat magnetic plates joined together to form a toroidal core, said toroidal core having an internal compartment accommodating inductance coils and an annular air gap between said coils, the improvement resulting in enhanced regulation of the mutual inductance of said inductance coils by forming a magnetic shunt between said inductance coils, said improvement comprising:

said flat magnetic plates being shaped to form a lateral air gap groove adjacent to and leading into said compartment within said toroidal core, and said compartment within said toroidal core being penetrated through said lateral air gap by an open hoop of magnetic material having a thickness of sufficient dimension to enable said open hoop to penetrate into said compartment within said toroidal core, said open hoop, being positioned between said inductance coils within said compartment, and the external diameter of said open hoop being of sufficient dimension to penetrate into said compartment and into said annular air gap between said inductance coils while leaving an air gap between a wall of the internal compartment and the outer periphery of said hoop.

* * * * *